US009313847B2

(12) United States Patent
Tao et al.

(10) Patent No.: US 9,313,847 B2
(45) **Date of Patent: *Apr. 12, 2016**

(54) LED LIGHT SOURCE

(75) Inventors: Haimin Tao, Eindhoven (NL); Martinus Petrus Creusen, Wijire (NL); Ralph Kurt, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 68 days.

This patent is subject to a terminal disclaimer.

(21) Appl. No.: 14/007,492

(22) PCT Filed: Mar. 28, 2012

(86) PCT No.: PCT/IB2012/051495

§ 371 (c)(1),
(2), (4) Date: Sep. 25, 2013

(87) PCT Pub. No.: WO2012/131602

PCT Pub. Date: Oct. 4, 2012

(65) Prior Publication Data

US 2014/0015428 A1 Jan. 16, 2014

(30) Foreign Application Priority Data

Mar. 31, 2011 (EP) ..... 11160660.4

(51) Int. Cl.
*H05B 33/08* (2006.01)

(52) U.S. Cl.
CPC ..... *H05B 33/083* (2013.01); *H05B 33/0809* (2013.01)

(58) Field of Classification Search
CPC .... H05B 37/02; H05B 33/08; H05B 33/0809; H05B 33/0812; H05B 33/0815; H05B 33/083; H05B 33/0836
USPC ..... 315/122, 185 R, 192, 193, 224, 226, 315/291, 294, 308, 312
See application file for complete search history.

(56) References Cited

U.S. PATENT DOCUMENTS

| | | | | |
|---|---|---|---|---|
| 7,081,722 | B1 | 7/2006 | Huynh | |
| 7,439,944 | B2 * | 10/2008 | Huynh et al. | 345/82 |
| 7,564,198 | B2 | 7/2009 | Yamamoto | |
| 8,384,307 | B2 * | 2/2013 | Grajcar | 315/307 |
| 2008/0094000 | A1 | 4/2008 | Yamamoto | |
| 2009/0230883 | A1 | 9/2009 | Haug | |
| 2010/0134018 | A1 * | 6/2010 | Tziony et al. | 315/122 |
| 2010/0231135 | A1 | 9/2010 | Hum | |
| 2010/0308738 | A1 * | 12/2010 | Shteynberg et al. | 315/185 R |
| 2011/0025216 | A1 | 2/2011 | Ching-Chi | |

FOREIGN PATENT DOCUMENTS

JP 2007123562 A 5/2007

* cited by examiner

*Primary Examiner* — Thai Pham

(57) ABSTRACT

LED light source comprising a string of LED loads (LED1-LED4) supplied by a rectified mains voltage. The number of LED loads carrying current is increased as the momentary amplitude of the rectified mains voltage increases, and is decreased as the momentary amplitude of the rectified mains voltage decreases. The order in which the LED loads start carrying a current and the order in which the LED loads stop carrying a current is reversed for each half period of the mains.

9 Claims, 3 Drawing Sheets

LED LIGHT SOURCE

FIELD OF THE INVENTION

The invention relates to an inexpensive and simple LED light source comprising N LED loads that is directly connectable to a supply source supplying a low-frequency AC voltage, such as the mains supply.

BACKGROUND OF THE INVENTION

Such a LED light source is known from U.S. Pat. No. 7,081,722. The LED loads are LED arrays comprising series arrangements and possibly parallel arrangements of individual LEDs. During operation, a periodic DC voltage with a frequency 2f and an amplitude varying between zero Volt and a maximum amplitude is present between the output terminals of the rectifier. When the amplitude of the periodic DC voltage is zero Volt, none of the LED loads carries current. When the amplitude of the periodic DC voltage increases, a voltage is reached at which the first LED load starts carrying current. Similarly, when the amplitude of the periodic DC voltage increases further to a high enough value, the second LED load starts conducting.

A further increase of the amplitude of the periodic DC voltage subsequently causes the remaining LED loads to start carrying current.

When all the LED loads carry current, the amplitude of the periodic DC voltage increases further until the maximum amplitude is reached. After that, the amplitude of the periodic DC voltage starts decreasing. While the amplitude decreases, the LED loads stop conducting current one after another in reversed order (first the Nth LED load stops conducting and the first LED load is the last to stop conducting). After the first LED load has stopped conducting, the amplitude of the periodic DC current decreases further to zero and then the cycle described hereinabove is repeated.

The known LED light source is very compact and comparatively simple. Furthermore, it can be directly supplied with power from a low-frequency AC supply voltage source, such as the European or American mains supply. LED-utilization is defined as follows:

LED_Utilization (in case $N$=4)=($I$_LED1_AVG/
$I$_LED1_AVG*Vseg1+$I$_LED2_AVG/
$I$_LED1_AVG*Vseg2+$I$_LED3_AVG/
$I$_LED1_AVG*Vseg3+$I$_LED4_AVG/
$I$_LED1_AVG*Vseg4)/Vstring_total wherein I_LED#_AVG is the average current through the LED load, evaluated over one period of the low-frequency AC supply voltage, Vseg# is the LED load voltage, Vstring total is the total voltage of all 4 LED loads.

The low LED utilization is caused by the fact that the different LED loads conduct current during time lapses of substantially different duration within a period of the periodic DC voltage. The Nth LED load carries a current during a much shorter time interval than the first LED load. As a consequence, the first LED load carries a higher average current than the Nth LED load. The LED loads are generally formed by one or more LED packages comprising a number of multi-junction LED dies. Since, during the manufacturing process, the packages that will be used in the first LED load are not discriminated from the packages that will be used in any of the other LED loads, all the packages have the same die size and package power capacity that has to meet worst case requirements. In this case, worst case requirements correspond to the use of the package in a first LED load (that, during operation, carries the highest average current of all the LED loads). However, most of the LED packages used in the LED light source are not used in the first LED load.

SUMMARY OF THE INVENTION

It is an object of the invention to provide a LED light source having a comparatively high LED utilization, and a corresponding method.

According to an aspect of the present invention, such a LED light source is provided comprising

- a first input terminal and a second input terminal for connection to a supply voltage source supplying a low-frequency AC supply voltage with a frequency f,
- a rectifier coupled to the input terminals for rectifying the low-frequency AC supply voltage,
- a series arrangement comprising N LED loads, a first and a second end of said series arrangement being coupled to a first output terminal and a second output terminal of the rectifier, respectively,
- control means for, subsequently, in a first operating state and during half a period of the low-frequency AC voltage, making the LED loads carry current, one after another in a first order and in dependence on the momentary amplitude of the low-frequency AC supply voltage when the amplitude increases and for subsequently making the LED loads stop carrying current, one after another and in a second order, that is reversed with respect to the first order, and in dependence on the momentary amplitude of the low frequency AC supply voltage when the amplitude decreases, and for subsequently, in a second operating state and during half a period of the low frequency AC voltage, making the LED loads carry current, one after another and in the second order and in dependence on the momentary amplitude of the low frequency AC supply voltage when the amplitude increases, and for subsequently making the LED loads stop carrying current, one after another in the first order and in dependence on the momentary amplitude of the low frequency AC supply voltage when the amplitude decreases, and wherein the control means is further equipped with circuitry for changing the operating state at every zero crossing of the low frequency AC supply voltage.

In a LED light source according to the invention, the order in which the LED loads start carrying current is reversed at each zero crossing of the low-frequency AC supply voltage. As a consequence, the Nth LED load and the first LED load carry the same average current during each period of the low-frequency AC supply voltage. The same is true for the second LED load and the (N−1)th LED load and more generally for the nth LED load and the (N−n+1)th LED load, wherein n is an integer ≤0.5N. (In case N is odd, the LED load in the middle carries the same average current during each half period of the low-frequency AC supply voltage.) Since the average currents through the LED loads differ much less than in the prior art, the LED utilization is much higher and therefore the LED packages used in the LED loads can be much cheaper than in the prior art.

In a first preferred embodiment of a LED light source according to the invention, the control means comprise

- N control strings comprising a switch and shunting the first to the Nth LED load, respectively,
- a control circuit coupled to the N control strings for controlling the switches comprised in the control strings, and a current source coupled between the Nth LED load and the second output terminal of the rectifier.

The order in which the LED loads start carrying current and the number of LED loads carrying current at any moment in time is determined by the switches, and the current source controls the amplitude of the current carried by the LED load(s).

In a second preferred embodiment of a LED light source according to the invention, the control means comprises N control strings comprising a switchable current source and connecting the cathode of a LED load to the second output terminal of the rectifier, N−1 further control strings, each comprising a switch and shunting the first to the (N−1)th LED load, respectively, and a control circuit coupled to the switchable current sources in the control strings and the switches comprised in the further control strings.

Also in this second preferred embodiment, the switches determine the order in which the LED loads start carrying current and how many LED loads are carrying current at any moment in time. At any moment, only one of the current sources is conductive and controls the current through the LED load(s).

Preferably, the switches comprised in the control strings shunting the LED loads in the first or second preferred embodiment comprise bipolar transistors having their base electrode connected to the second output terminal of the rectifier by means of a series arrangement of an impedance and a switching element.

Controlling the switches comprised in the control strings can thus take place in a comparatively simple and dependable way.

In a further preferred embodiment of a LED light source according to the invention, the LED light source further comprises:

a series arrangement of a capacitive element and a switch S, a second control circuit coupled to the switch S for rendering the switch conductive and non-conductive in dependence on the momentary amplitude of the low-frequency AC supply voltage. The switch S is controlled in dependence on the momentary amplitude of the rectified low-frequency AC supply voltage in such a way that the capacitive element is charged when the momentary amplitude of the low-frequency AC supply voltage is high and functions as a further supply source when the amplitude is low. In this way, the total amount of current supplied to the LED loads is increased.

Good results have been obtained for a LED light source according to the invention, wherein N is between 3 and 6.

Good results have also been obtained for a Led light source according to the invention, wherein each of the LED loads has the same forward voltage.

According to another aspect of the present invention, a method is provided of supplying a series arrangement of N LED loads, comprising the following steps:

providing a low-frequency AC supply voltage with frequency f, rectifying the low-frequency AC supply voltage, supplying the rectified AC supply voltage to the series arrangement comprising N LED loads, and subsequently, in a first operating state, during half a period of the low-frequency AC supply voltage, making the LED loads carry current, one after another, starting with a first LED load that is closest to a first end of the series arrangement, in dependence on the momentary amplitude of the low-frequency AC supply voltage, when the amplitude increases, and subsequently, making the LED loads stop carrying current, one after another, starting with the Nth LED load, in dependence on the momentary amplitude of the low-frequency AC supply voltage, when the amplitude decreases, and subsequently, in a second operating state, during half a period of the low-frequency AC supply voltage, making the LED loads carry current, one after another, starting with the Nth LED in dependence on the momentary amplitude of the low-frequency AC supply voltage, when the amplitude increases, and subsequently, making the LED loads stop carrying current, one after another, starting with the first LED load, in dependence on the momentary amplitude of the low-frequency AC supply voltage, when the amplitude decreases, changing the operating state at every zero crossing of the low-frequency AC supply voltage.

BRIEF DESCRIPTION OF THE DRAWINGS

Embodiments of a LED light source according to the invention will be further described, making use of a drawing.

In the drawing.

DETAILED DESCRIPTION OF PREFERRED EMBODIMENTS

Figure 1:
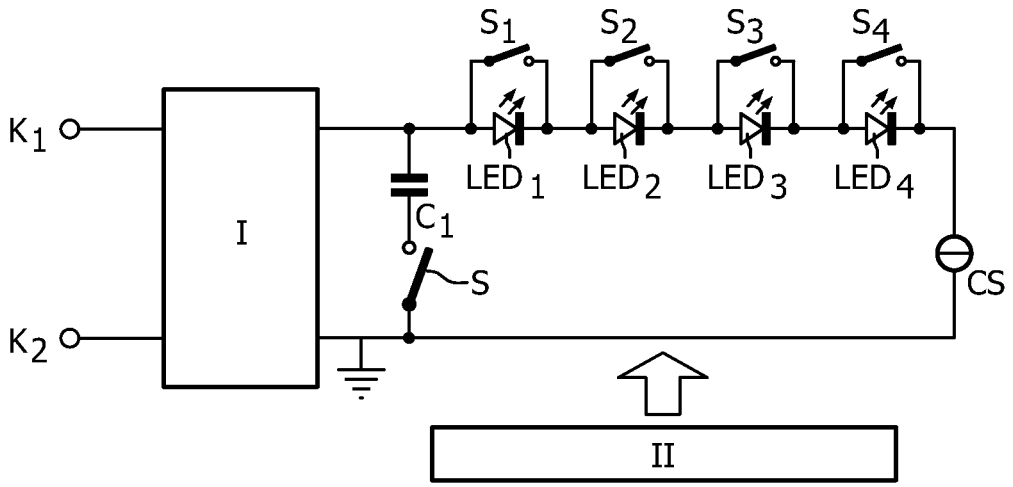
FIGS. 1-2 show schematic representations of embodiments of a LED light source according to the invention.

In FIG. 1, K1 and K2 are first and second input terminals, respectively, for connection to a low-frequency supply voltage source, such as the European or American mains supply.

Reference I is a rectifier coupled to the input terminals for rectifying the low-frequency AC supply voltage. Output terminals of the rectifier are connected by means of a series arrangement of a capacitive element C1 and a switch S. The output terminals are also connected by a series arrangement of four LED loads LED1-LED4 and a current source CS. Each of the LED loads is shunted by a control string comprising a switch. These switches are labeled S1 to S4. Reference II is a control circuit for controlling the switches S1-S4 and also switch S. Switches S1-S4, current source CS and the control circuit II together form control means.

It is noted that it is possible to connect the output terminals of the rectifier by means of a bleeder to make the LED light source compatible with a phase-cut dimmer.

During operation, the switch S is controlled in dependence on the momentary amplitude of the rectified low-frequency AC supply voltage in such a way that the capacitive element is charged when the momentary amplitude of the low-frequency AC supply voltage is high, and functions as an additional supply source when the amplitude is low. Although this additional supply source is preferred, it is not necessary.

The operation of the LED light source shown in FIG. 1 will now be described, assuming that a bleeder and the additional supply source are both dispensed with.

In case the input terminals K1 and K2 are connected to a supply voltage source supplying a low-frequency AC voltage with frequency f, a periodic DC voltage with a frequency 2f is present between the output terminals of the rectifier. During a first period of the periodic DC voltage, when the control means are in a first operational state and the momentary amplitude of the periodic DC voltage is low, switch S1 is non-conductive while switches S2-S4 are maintained in a conductive state. When the momentary amplitude of the periodic DC voltage has increased to the forward voltage of the first LED load LED1, LED load LED1 starts conducting a current. When the momentary amplitude of the periodic DC voltage increases further to a value that equals the sum of the forward voltages of LED loads LED1 and LED2, switch S2 is rendered non-conductive and LED load LED2 starts to carry a current. Similarly switch S3 is rendered non-conductive and LED load LED3 starts to carry current when the momentary amplitude of the periodic DC voltage equals the sum of the forward voltages of the LED loads LED1, LED2 and LED3. When the momentary amplitude of the periodic DC voltage equals the sum of the forward voltages of all the LED loads, switch S4 is rendered non-conductive and LED load LED4 starts conducting current. The momentary amplitude then increases to its maximum value and subsequently starts to decrease. During this decrease the LED loads are rendered non-conductive one after another in a reversed order. When the momentary amplitude of the periodic DC voltage drops below the sum of the four forward voltages, switch S4 is rendered conductive and LED load LED4 stops carrying current. The momentary amplitude of the periodic DC voltage decreases further and when it becomes lower than the sum of the forward voltages of LED loads LED1, LED2 and LED3, switch S3 is rendered conductive and LED load LED3 stops carrying current. A further decrease of the momentary amplitude of the periodic DC voltage subsequently causes LED load LED2 and LED load LED1 to stop carrying current when the momentary amplitude of the periodic DC voltage drops below the sum of the forward voltages of LED loads LED1 and LED2, and when the momentary amplitude drops below the forward voltage of LED load LED1, respectively. In the described embodiment, the current carried by (part of) the LED loads is maintained at a constant value during one period of the periodic DC voltage. It is noted that it is also possible to change the amplitude of the current during a period of the periodic DC voltage for instance to suppress flicker.

During a second period of the periodic DC voltage, the control means are in a second operational state, wherein, during the increase of the momentary amplitude, the LED loads start carrying current one after another in reversed order with respect to the first operational state. When the momentary amplitude of the periodic DC voltage is very low, switches S1-S3 are conductive and switch S4 is non-conductive.

When the momentary amplitude of the periodic DC voltage equals the forward voltage of LED load LED4, LED load LED4 starts conducting current. A further increase of the momentary amplitude of the periodic DC voltage causes LED loads LED3, LED2 and LED1 to start carrying current one after another, and hence switches S3, S2 and S1 to be rendered non-conductive, respectively. When the momentary amplitude of the periodic DC voltage decreases, LED loads LED1, LED2, LED3 and LED4 stop carrying current one after another in this order. Similarly, switches S1-S3 are rendered conductive in this order. It serves no purpose to render switch S4 conductive when the momentary amplitude drops below the forward voltage of LED load LED4, since this would merely cause a current flow that does not flow through the LED loads and therefore does not generate light.

In each period of the periodic DC voltage, the switch S is rendered conductive during a time lapse when the momentary amplitude of the periodic DC voltage is comparatively high. As a consequence, the capacitive element C1 is charged during this time lapse. During another time lapse, when the amplitude of the periodic DC voltage is comparatively low, the switch S is also rendered conductive. During this other time lapse, the voltage across the capacitive element is higher than the momentary amplitude of the periodic DC voltage and the capacitive element functions as a supply voltage source for supplying a current to (part of) the LED loads. In the next period of the periodic DC voltage (=the next half period of the low frequency AC voltage), the control means is in its first operating state again and the operation described hereinabove is repeated.

It is noted that the order in which the LED loads are made to conduct current in the first operating state does not need to be LED1-LED2-LED3-LED4, but can be any order as long as the LED loads are rendered conductive in a reversed order during the second operating state, for instance LED1-LED4-LED2-LED3 can be the first order in the first operating state and LED3-LED2-LED4-LED1 can be the second order in the second operating state. The same LED utilization is achieved irrespective of the order in which the LED loads are made conductive.

Figure 2:
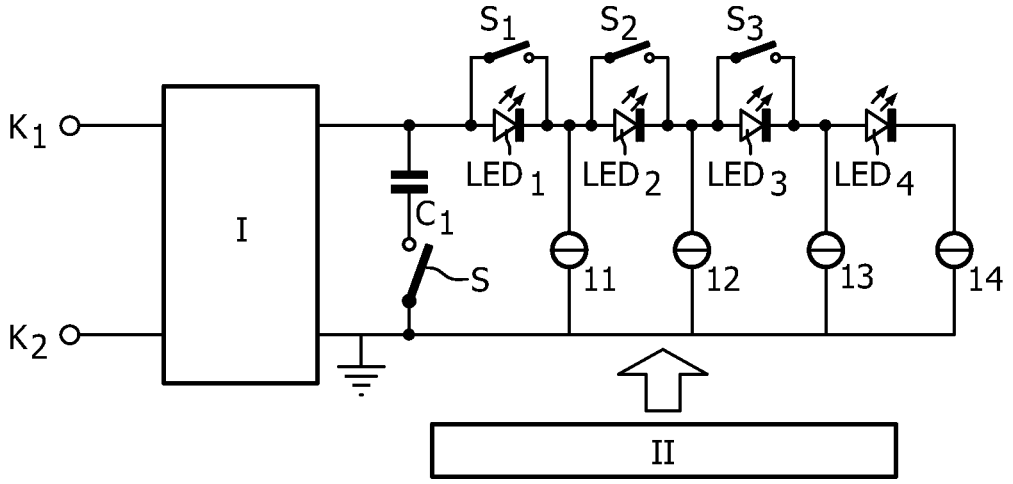

In FIG. 2, components and circuit parts similar to components and circuit parts shown in FIG. 1 are labeled with the same references. In FIG. 2, the cathodes of each of the LED loads are connected to the second output terminal of the rectifier by means of a control string comprising a switchable current source. These current sources have reference numbers 11-14. Only LED loads LED1-LED3 are shunted by a control string comprising a switch, instead of all the LED loads as in the embodiment shown in FIG. 1. In the embodiment shown in FIG. 2, switches S1-S3 and switch S as well as switchable current sources 11-14 are controlled by the control circuit II.

Also in the case of the embodiment in FIG. 2, the operation is described for the situation that the capacitor C1 and the switch S are dispensed with.

The operation of the embodiment shown in FIG. 2 is as follows.

In the case that the input terminals K1 and K2 are connected to a supply voltage source supplying a low-frequency AC voltage with a frequency f, a periodic DC voltage with a frequency 2f is present between the output terminals of the rectifier. During a first period of the periodic DC voltage, when the control means are in a first operational state, the switches S1-S3 are all maintained in a non-conductive state.

When the momentary amplitude of the periodic DC voltage increases, current source 11 is activated and the first LED load LED1 starts conducting current when the momentary amplitude of the periodic DC voltage equals the forward voltage of the first LED load. When the momentary amplitude of the periodic DC voltage increases further and equals the sum of the forward voltages of LED loads LED1 and LED2, current source 11 is switched off and current source 12 is switched on, and the second LED load LED2 starts conducting current. When, in the case of a further increase of the momentary amplitude of the periodic DC voltage, the momentary amplitude equals the sum of the forward voltages of the first three LED loads, current source 12 is switched off, current source 13 is switched on and the third LED load starts conducting current. When the momentary amplitude of the periodic DC voltage equals the sum of the forward voltages of all the LED loads LED1-LED4, current source 13 is switched off, current source 14 is switched on and the fourth LED load LED4 starts carrying current. The momentary amplitude then increases further to its maximum value and subsequently starts to decrease. During this decrease, the four LED loads LED1-LED4 stop carrying current one after another in reversed order, starting with LED load LED4. When the momentary amplitude of the periodic DC voltage drops below the sum of the forward voltages of the four LED loads, current source 14 is switched off, current source 13 is switched on and LED load LED4 stops conducting. When the momentary amplitude drops further by an amount equalling the forward voltage of the third LED load LED3, current source 13 is switched off, current source 12 is switched on and the third LED load LED3 stops conducting current. Similarly, when the momentary amplitude drops further by an amount equalling the forward voltage of the second LED load LED2, current source 12 is switched off, current source 11 is switched on and the second LED load LED2 stops conducting current. When the momentary amplitude decreases further by an amount equalling the forward voltage of the first LED load LED1, the current source 11 is switched off and the first LED load LED1 stops carrying current. The momentary amplitude of the periodic DC voltage decreases further to zero and then the next period of the periodic DC voltage starts. During this next period, the control means are in the second operational state. As a consequence, the switches S1-S3 all are conductive at the beginning of this next period and all the current sources are switched off. In the first half of this next period, the LED loads start carrying current one after another in an order that is reversed from the order in which they started carrying current during the first period. In this next period, only current source 14 is activated and current sources 11, 12 and 13 are disabled.

The momentary amplitude of the periodic DC voltage increases, and when it equals the forward voltage of LED load LED4, current source 14 is switched on and LED load LED4 starts carrying current. When the momentary amplitude of the periodic DC voltage equals the sum of the forward voltages of LED loads LED4 and LED3, switch S3 is rendered non-conductive and LED load LED 3 starts conducting current. Similarly, when the momentary amplitude of the periodic DC voltage equals the sum of the forward voltages of LED loads LED4, LED3 and LED2, switch S2 is rendered non-conductive and LED load LED2 starts conducting current. When the momentary amplitude increases further by an amount equalling the forward voltage of the first LED load LED1, switch S1 is rendered non-conductive and the first LED load LED1 starts carrying current.

The momentary amplitude of the periodic DC voltage increases further to its maximum value and then starts to decrease. During this decrease, the four LED loads LED1-LED4 stop carrying current one after another in reversed order, starting with LED load LED1. When the momentary amplitude of the periodic DC voltage drops below the sum of the forward voltages of the four LED loads, switch S1 is rendered conducting and the first LED load LED1 stops carrying current. When the momentary amplitude drops further and becomes lower than the sum of the forward voltages of LED loads LED2, LED3 and LED4, switch S2 is rendered conducting and the second LED load LED2 stops conducting current. Similarly, when the momentary amplitude drops further and becomes lower than the sum of the forward voltages of LED loads LED3 and LED4, switch S3 is rendered conducting and the third LED load LED3 stops conducting current. When the momentary amplitude decreases further and becomes lower than the forward voltage of the LED load LED4, the current source 14 is switched off and the fourth LED load LED4 stops carrying current. The momentary amplitude of the periodic DC voltage decreases further to zero and then the next period of the periodic DC voltage starts.

In this next period, the control means are in the first operational state again and the operation described hereinabove starts once more.

Figure 3:
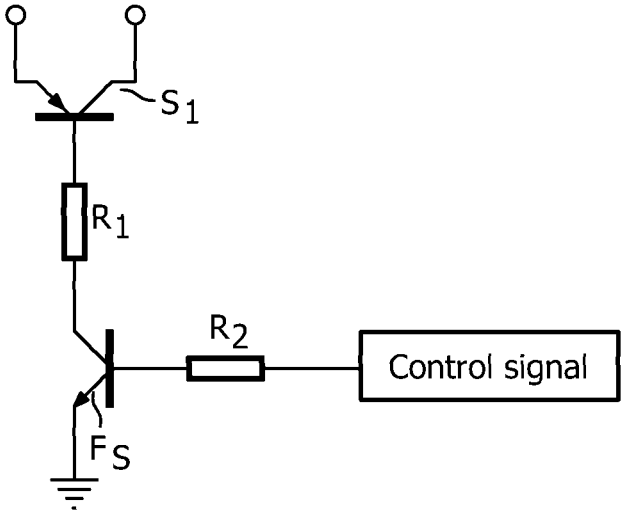
FIG. 3 shows a switch comprised in a control string with a level shifter connected to a control electrode of the switch.

FIG. 3 shows an implementation of one of the switches S1 in the embodiments shown in FIG. 1 and FIG. 2. S1 is a bipolar transistor. The base electrode of bipolar switch S1 is connected to the collector of a further bipolar switch FS by means of a resistor R1. The emitter of the further bipolar switch is connected to the second output terminal of the rectifier, which is at ground potential (see also FIG. 1 and FIG. 2). Switch S1 can be controlled in a conductive or non-conductive state by controlling the further switch FS in a conductive or a non-conductive state, respectively. Control signals for controlling the further switch FS can be generated comparatively easily, because the emitter of further switch FS is at ground potential. As a consequence, the circuit part shown in FIG. 3 allows a comparatively simple control of the switches comprised in the control strings.

Figure 4:
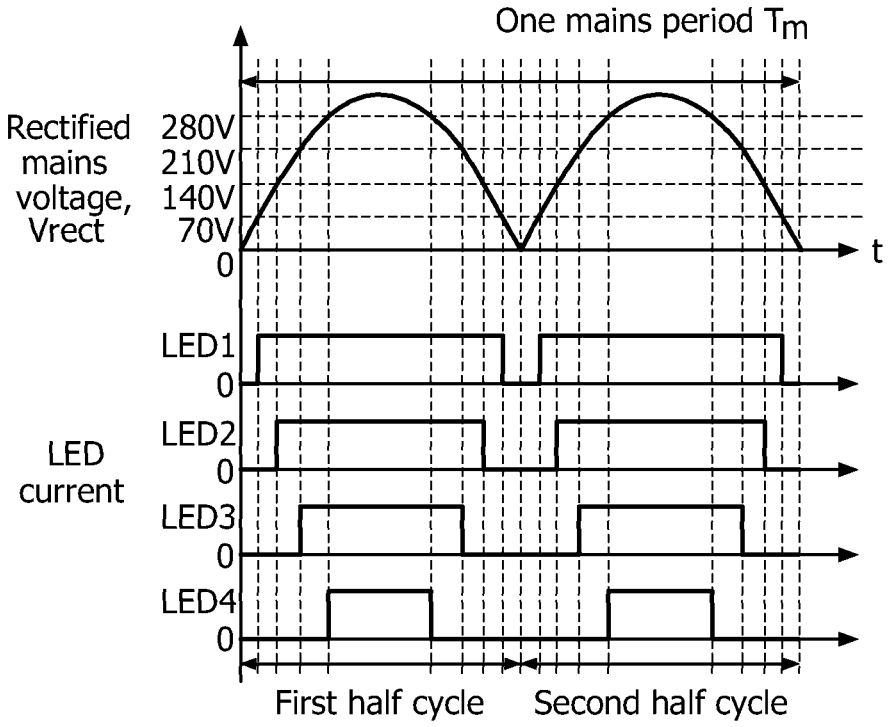
FIG. 4 shows the current through different LED loads as a function of time for a prior art LED load circuit.

FIG. 4 shows the shape of voltages and currents in a prior art LED light source comprising four LED loads and being European mains supplied. Two periods of the rectified mains voltage are shown.

FIG. 4 further shows the shape of the current through each of the LED loads. The control means of such a prior art LED light source are always in the same operational state. As a consequence, the shape of the current through the LED loads is the same in each period of the periodic DC voltage. Consequently, the average current through each of the LED loads is different and the average current through LED load LED4 is much smaller than the average current through LED load LED1.

Figure 5:
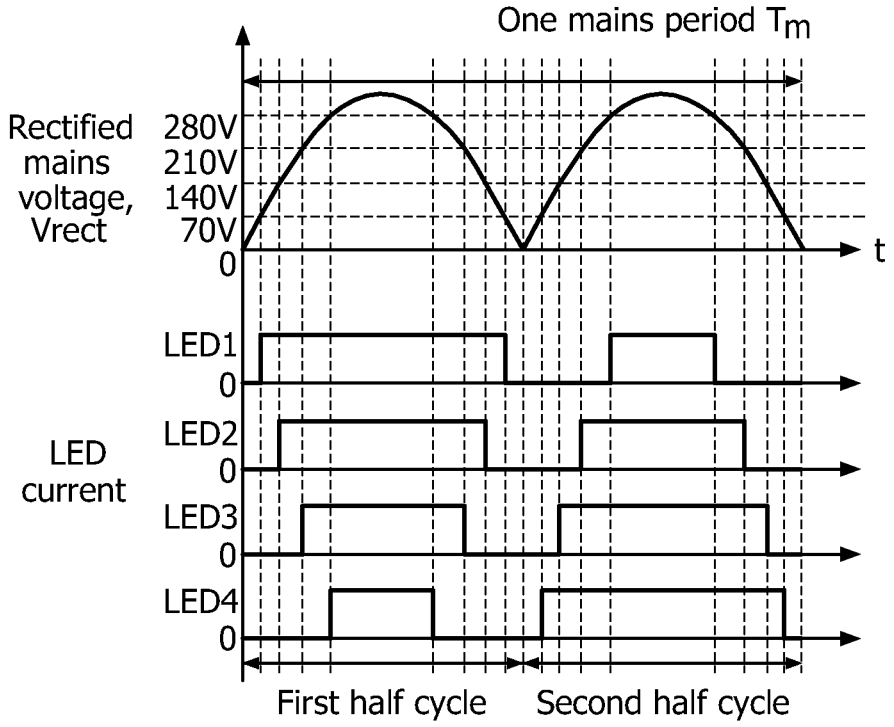
FIG. 5 shows the current through different LED loads as a function of time for a LED load circuit as shown in FIG. 1.

FIG. 5 shows the shape of corresponding voltages and currents in a LED light source according to the invention, comprising four LED loads and being European mains supplied.

It can be seen that the current through the first LED load LED1, averaged over two periods of the periodic DC voltage, is equal to the current through LED load LED4, averaged over two periods of the periodic DC voltage. Similarly, the average currents through the second LED load LED2 and the third LED load LED3 are also equal to each other. Furthermore, the average currents through the first LED load LED1 and the second LED load LED2 of a LED light source according to the invention differ less than the average current through the first LED load LED1 and the average current through the fourth LED load LED4 in a prior art LED light source.

Figure 6:
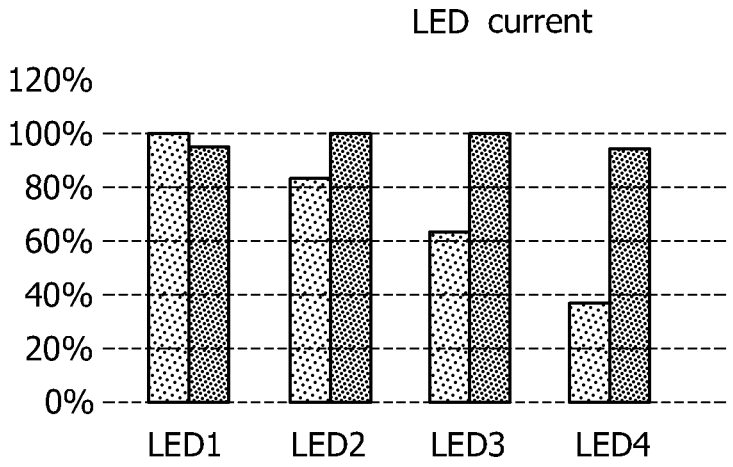
FIG. 6 shows the average LED current through the LED loads for a prior art LED light source and for a LED light source as shown in FIG. 1.

This is further illustrated in FIG. 6. In FIG. 6, the first columns show the average current through each of the four LED loads of a prior art LED light source operating always in the same operational state (a light source mentioned in the first paragraph of page 1). The second columns show the average current through each of the four LED loads of a LED light source according to the invention. It can be seen that the differences between the average currents through the LED loads is much smaller in the case of a LED light source according to the invention. This means that the LED utilization is much higher and, therefore, the LED packages used to form the LED loads can be much cheaper.

The invention claimed is:

1. A LED light source comprising a first input terminal and a second input terminal for connection to a supply voltage source supplying a low-frequency AC supply voltage with a frequency f, a rectifier coupled to the input terminals for rectifying the low-frequency AC supply voltage, a series arrangement comprising N LED loads, wherein N is an integer greater than or equal to 2, a first and a second end of said series arrangement being coupled to a first output terminal and a second output terminal of the rectifier, respectively, control means for, subsequently, in a first operating state during half a period of the low frequency AC voltage, making the LED loads carry current, one after another in a first order and in dependence on the momentary amplitude of the low-frequency AC supply voltage when the amplitude increases, and for subsequently making the LED loads stop carrying current, one after another and in a second order, that is reversed with respect to the first order and in dependence on the momentary amplitude of the low-frequency AC supply voltage when the amplitude decreases, and for, subsequently, in a second operating state during half a period of the low frequency AC voltage, making the LED loads carry current, one after another and in the second order and in dependence on the momentary amplitude of the low frequency AC supply voltage when the amplitude increases, and for subsequently making the LED loads stop carrying current, one after another in the first order, and in dependence on the momentary amplitude of the low-frequency AC supply voltage when the amplitude decreases, and wherein the control means is further equipped with circuitry for changing the operating state at every zero crossing of the low-frequency AC supply voltage.

2. The LED light source according to claim 1, wherein the control means comprises N control strings comprising a switch and shunting the first to the Nth LED load, respectively, a control circuit coupled to the N control strings for controlling the switches comprised in the control strings, and a current source couped between the Nth LED load and the second output terminal of the rectifier.

3. The LED light source according to claim 1, wherein the control means comprises N control strings comprising a switchable current source and connecting the cathode of a LED load to the second output terminal of the rectifier, N−1 further control strings each comprising a switch and shunting the first to the (N−1)th LED load, respectively, and a control circuit coupled to the switchable current sources in the control strings and the switches comprised in the further control strings.

4. The LED light source according to claim 2, wherein the switches in the control strings shunting the LED loads comprise bipolar transistors having their base electrode connected to the second output terminal of the rectifier by means of a series arrangement of an impedance and a switching element.

5. The LED light source according to claim 1, wherein the LED light source further comprises a series arrangement of a capacitive element and a switch S, a control circuit coupled to the switch S for rendering the switch conductive and non-conductive in dependence on the momentary amplitude of the low-frequency AC supply voltage.

6. The LED light source according to claim 1, wherein N is a number of LED loads between 3 and 6.

7. The LED light source according to claim 1, wherein each of the LED loads has a same forward voltage.

8. A LED light source comprising a first input terminal and a second input terminal for connection to a supply voltage source supplying a low-frequency AC supply voltage with a frequency f, a rectifier coupled to the input terminals for rectifying the low-frequency AC supply voltage, a series arrangement comprising N LED loads, wherein N is an integer greater than or equal to 2, a first and a second end of said series arrangement being coupled to a first output terminal and a second output terminal of the rectifier respectively, control means for, subsequently, making the N LED loads carry current during each half period of the low-frequency AC supply voltage, one after another in a first order, when the amplitude of the low-frequency AC supply voltage increases, and for subsequently making the N LED loads stop carrying current one after another in a second order that is reversed with respect to the first order, when the amplitude of the low-frequency AC supply voltage decreases, wherein in each of N subsequent half periods of the low-frequency AC supply voltage, the nth LED load that is made to conduct current differs from the nth LED load that is made to conduct current in every other half period of the N subsequent half periods for each value of n, wherein n is an integer and $1 \leq n \leq N$, wherein n is an integer$\leq 0.5N$.

9. A method of supplying power to a LED light source equipped with a series arrangement of N LED loads, comprising the steps of providing a low-frequency AC supply voltage with a frequency f, rectifying the low-frequency AC supply voltage, supplying the rectified AC supply voltage to the series arrangement comprising N LED loads, wherein N is an integer greater than or equal to 2, and subsequently, in a first operating state during half a period of the low frequency AC supply voltage, making the LED loads carry a current, one after another, starting with a first LED load that is closest to a first end of the series arrangement, in dependence on the momentary amplitude of the low-frequency AC supply voltage, when the amplitude increases, and subsequently, making the LED loads stop carrying current, one after another, starting with the Nth LED load, in dependence on the momentary amplitude of the low-frequency AC supply voltage, when the amplitude decreases, and subsequently, in a second operating state during half a period of the low frequency AC supply voltage, making the LED loads carry current, one after another, starting with the Nth LED in dependence on the momentary amplitude of the low-frequency AC supply voltage, when the amplitude increases, and subsequently, making the LED loads stop carrying current, one after another, starting with the first LED load, in dependence on the momentary amplitude of the low-frequency AC supply voltage, when the amplitude decreases, and changing the operating state at every zero crossing of the low-frequency AC supply voltage.

* * * * *